US007950817B2

(12) United States Patent
Zulim et al.

(10) Patent No.: US 7,950,817 B2
(45) Date of Patent: May 31, 2011

(54) LIGHTING ASSEMBLIES FOR VENDING MACHINES

(75) Inventors: Dalibor Zulim, Conyers, GA (US); Mark Anthony Hand, Covington, GA (US); Forrest Starnes McCanless, Oxford, GA (US)

(73) Assignee: ABL IP Holding LLC, Conyers, GA (US)

( * ) Notice: Subject to any disclaimer, the term of this patent is extended or adjusted under 35 U.S.C. 154(b) by 376 days.

(21) Appl. No.: 12/175,063

(22) Filed: Jul. 17, 2008

(65) Prior Publication Data

US 2009/0091271 A1 Apr. 9, 2009

Related U.S. Application Data

(60) Provisional application No. 60/997,999, filed on Oct. 5, 2007.

(51) Int. Cl.
*A47F 11/10* (2006.01)

(52) U.S. Cl. ... 362/125; 362/227; 362/234; 362/249.02; 362/253; 362/800

(58) Field of Classification Search ..... 362/125, 362/127, 133, 154, 227, 234, 249.01–249.02, 362/253, 800; 221/155
See application file for complete search history.

(56) References Cited

U.S. PATENT DOCUMENTS

| | | | |
|---|---|---|---|
| 845,652 | A | 2/1907 | La Berge |
| 1,149,140 | A | 8/1915 | Hess |
| 3,617,729 | A | 11/1971 | Lassen |
| 3,886,348 | A | 5/1975 | Jonathan et al. |
| 4,598,341 | A | 7/1986 | Brackhahn et al. |
| 4,689,726 | A | 8/1987 | Kretzschmar |
| 4,739,454 | A | 4/1988 | Federgreen |
| 4,748,545 | A | 5/1988 | Schmitt |
| 4,799,133 | A | 1/1989 | Strzalko et al. |

(Continued)

FOREIGN PATENT DOCUMENTS

| | | |
|---|---|---|
| EP | 0303741 | 2/1989 |

(Continued)

OTHER PUBLICATIONS

Display Case Lighting, http://www.Kevan-Shaw.com/pdf/display_case.pdf, 5 sheets, Dec. 21, 1997.

(Continued)

*Primary Examiner* — Stephen F Husar
*Assistant Examiner* — Meghan K Dunwiddie
(74) *Attorney, Agent, or Firm* — Kilpatrick Townsend & Stockton

(57) ABSTRACT

Display cases having lighting assemblies and methods of illuminating display cases with such lighting assemblies. Embodiments of the lighting assemblies may be used in display cases of any type and particularly in those where the purchaser selects via an external mechanism (e.g., buttons) a product from a variety of products stored inside the display, such as a vending machine. Lighting assemblies are installed within a vending machine, such as on or within the vending machine shelves or product dividers, and their light emission controlled depending on the product being selected from the vending machine. In on embodiment, all light sources within the vending machine except those illuminating the selected product are dimmed. In this way, the product being selected by the purchaser can be emphasized. In other embodiments, color or multi-color LEDs are used to emit light that best compliments the color of products housed within the vending machine.

21 Claims, 6 Drawing Sheets

U.S. PATENT DOCUMENTS

| | | | | |
|---|---|---|---|---|
| 4,973,796 | A | 11/1990 | Dougherty et al. | |
| 4,979,078 | A | 12/1990 | Amstutz et al. | |
| 5,022,720 | A | 6/1991 | Fevig et al. | |
| 5,034,861 | A | 7/1991 | Sklenak et al. | |
| 5,040,101 | A | 8/1991 | Aspenwall | |
| 5,054,863 | A | 10/1991 | Amstutz et al. | |
| 5,057,978 | A | 10/1991 | Conti | |
| 5,072,343 | A | 12/1991 | Buers | |
| D330,090 | S | 10/1992 | Walter et al. | |
| 5,180,222 | A | 1/1993 | Robinson | |
| 5,205,638 | A | 4/1993 | Squitieri | |
| D344,605 | S | 2/1994 | Aspenwall | |
| 5,437,504 | A | 8/1995 | Halvatzis | |
| 5,471,372 | A | 11/1995 | Mamelson et al. | |
| 5,508,898 | A | 4/1996 | McGovern | |
| 5,722,747 | A | 3/1998 | Baron | |
| 5,836,669 | A | 11/1998 | Hed | |
| 5,873,646 | A | 2/1999 | Fjaestad et al. | |
| 5,879,070 | A | 3/1999 | Severloh | |
| 5,895,111 | A | 4/1999 | Santosuosso et al. | |
| 5,902,034 | A | 5/1999 | Santosuosso et al. | |
| 5,904,257 | A | 5/1999 | Marmet et al. | |
| 6,042,244 | A | 3/2000 | Witkoski | |
| 6,179,434 | B1 | 1/2001 | Saraiji | |
| D440,335 | S | 4/2001 | Kuo | |
| 6,210,013 | B1 | 4/2001 | Bousfield | |
| 6,211,626 | B1 | 4/2001 | Lys et al. | |
| 6,231,205 | B1 | 5/2001 | Slesinger et al. | |
| 6,283,608 | B1 | 9/2001 | Straat | |
| 6,292,901 | B1 | 9/2001 | Lys et al. | |
| 6,302,557 | B1 | 10/2001 | Santosuosso et al. | |
| D450,874 | S | 11/2001 | Heiny et al. | |
| 6,325,523 | B1 | 12/2001 | Santosuosso et al. | |
| 6,340,868 | B1 | 1/2002 | Lys et al. | |
| 6,401,969 | B1 | 6/2002 | Yajima et al. | |
| 6,406,108 | B1 | 6/2002 | Upton et al. | |
| 6,459,919 | B1 | 10/2002 | Lys et al. | |
| 6,478,444 | B2 | 11/2002 | Schaerer et al. | |
| 6,478,445 | B1 | 11/2002 | Lange et al. | |
| 6,510,995 | B2 | 1/2003 | Muthu et al. | |
| 6,533,130 | B1 | 3/2003 | Padiak et al. | |
| 6,550,269 | B2 | 4/2003 | Rudick | |
| 6,558,017 | B1 | 5/2003 | Saraiji et al. | |
| 6,566,824 | B2 | 5/2003 | Panagotacos et al. | |
| 6,578,978 | B1 | 6/2003 | Upton et al. | |
| 6,578,979 | B2 | 6/2003 | Truttmann-Bättig | |
| 6,632,100 | B1 | 10/2003 | Richardson | |
| 6,638,088 | B1 | 10/2003 | Richardson | |
| 6,641,419 | B1 | 11/2003 | Richardson | |
| 6,663,273 | B2 * | 12/2003 | Robey | 362/559 |
| 6,726,341 | B2 | 4/2004 | Pashley et al. | |
| D489,472 | S | 5/2004 | Newhouse et al. | |
| D493,009 | S | 7/2004 | Ken | |
| 6,773,130 | B1 | 8/2004 | Richardson | |
| 6,808,285 | B2 | 10/2004 | Shemitz | |
| 6,827,463 | B2 | 12/2004 | Chuang et al. | |
| 6,827,465 | B2 | 12/2004 | Shemitz et al. | |
| 6,834,452 | B2 | 12/2004 | Martin et al. | |
| 6,869,154 | B2 | 3/2005 | Vandenbussche | |
| 6,951,402 | B1 | 10/2005 | Copp | |
| 6,997,007 | B1 | 2/2006 | Wyatt | |
| D521,286 | S | 5/2006 | Colmenares | |
| 7,036,947 | B2 | 5/2006 | Chuang et al. | |
| 7,038,398 | B1 | 5/2006 | Lys et al. | |
| 7,121,675 | B2 | 10/2006 | Ter-Hovhannisian | |
| 7,131,746 | B2 | 11/2006 | Cook | |
| 7,157,667 | B2 | 1/2007 | Gramlich et al. | |
| 7,163,305 | B2 | 1/2007 | Bienick | |
| 7,201,487 | B2 | 4/2007 | Pinter | |
| D553,287 | S | 10/2007 | Miller | |
| 7,281,811 | B2 | 10/2007 | Thuot Rann et al. | |
| 7,284,876 | B2 | 10/2007 | Ericson | |
| 2004/0066646 | A1 | 4/2004 | Chuang et al. | |
| 2005/0030736 | A1 | 2/2005 | Chuang et al. | |
| 2005/0185395 | A1 | 8/2005 | Pinter | |
| 2005/0265019 | A1 | 12/2005 | Sommers et al. | |
| 2006/0012722 | A1 | 1/2006 | Moseley | |
| 2006/0209537 | A1 | 9/2006 | Stelmasik et al. | |
| 2006/0242981 | A1 | 11/2006 | Grassmuck et al. | |
| 2007/0058369 | A1 | 3/2007 | Parkyn et al. | |
| 2007/0064428 | A1 | 3/2007 | Beauchamp | |
| 2007/0070615 | A1 * | 3/2007 | Joslin et al. | 362/92 |
| 2007/0151274 | A1 | 7/2007 | Roche et al. | |
| 2007/0195535 | A1 | 8/2007 | Artwohl et al. | |
| 2007/0247831 | A1 | 10/2007 | Buelow, II et al. | |
| 2007/0256340 | A1 | 11/2007 | Kim | |
| 2008/0007945 | A1 | 1/2008 | Kelly et al. | |
| 2008/0094824 | A1 | 4/2008 | Stack et al. | |
| 2009/0002990 | A1 | 1/2009 | Becker et al. | |

FOREIGN PATENT DOCUMENTS

| | | |
|---|---|---|
| EP | 1627583 | 2/2006 |
| EP | 1761146 | 3/2007 |
| FR | 2654602 | 5/1991 |
| GB | 952388 | 3/1964 |
| GB | 1379276 | 1/1975 |
| GB | 2133196 | 7/1984 |
| GB | 2430536 | 3/2007 |
| JP | 55-091229 | 7/1980 |
| JP | 01-291085 | 11/1989 |
| JP | 03-233893 | 10/1991 |
| JP | 08-033053 | 2/1996 |
| JP | 08-146888 | 6/1996 |
| JP | 2000-175794 | 6/2000 |
| JP | 2001-141351 | 5/2001 |
| JP | 2001-215076 | 8/2001 |
| JP | 2002-078579 | 3/2002 |
| JP | 2002-147945 | 5/2002 |
| JP | 2002-168558 | 6/2002 |
| JP | 2005-285701 | 10/2005 |
| JP | 2006-092900 | 4/2006 |
| JP | 2006-166948 | 6/2006 |
| JP | 2006-334275 | 12/2006 |
| JP | 2007-117702 | 5/2007 |
| WO | WO 93/18499 | 9/1993 |
| WO | WO 94/21961 | 9/1994 |
| WO | WO 97/38610 | 10/1997 |
| WO | WO 99/31560 | 6/1999 |
| WO | WO 01/84985 | 11/2001 |
| WO | WO 2006/086998 | 8/2006 |
| WO | WO 2006/087000 | 8/2006 |
| WO | WO 2007/004615 | 1/2007 |
| WO | WO 2008/007297 | 1/2008 |
| WO | WO 2008/047335 | 4/2008 |

OTHER PUBLICATIONS

LED Museum Display Case Lighting, www.ledlightingfactory.com, 4 sheets, Apr. 28, 2007.

Display Case Lighting, www.residential-landscape-lighting-design.com/display-case-lighting.htm, 2 sheets, 2002-2008.

Lighting Resource Product Search—Accent Lighting, Display Case, www.lightingresource.com/applications/17, 40 sheets, Oct. 9, 1999.

XPO Display Case Lighting, www.visual-lighting.com/downloads/cutSheets/6101.pdf, pp. 38-39, 1999-2006.

Exhibition Lighting a Full Range, www.cokerexpo.co.uk/lighting.htm, 13 sheets, Jul. 11, 2007.

Tradeshow Cases and Exhibit Cases—Display Cases—Lighting Cases, www.starcase.com/tradeshowandexibitcases.htm, 5 sheets, Jun. 1, 2000.

Hasting Lighting Company—Showcase Lighting, Display Case Lighting, www.hastingslighting.com, Product Catalog pgs. 23 sheets.

Non-Final Office Action in U.S. Appl. No. 12/164,822 mailed from the U.S. Patent and Trademark Office on Apr. 14, 2010.

Response to Non-Final Office Action filed Aug. 13, 2010 in U.S. Appl. No. 12/164,822.

Final Office Action in U.S. Appl. No. 12/164,822 mailed from the U.S. Patent and Trademark Office on Nov. 9, 2010.

* cited by examiner

LIGHTING ASSEMBLIES FOR VENDING MACHINES

CROSS-REFERENCE TO RELATED APPLICATIONS

This application claims the benefit of U.S. Provisional Application No. 60/997,999, entitled "Refrigeration Lighting Unit" and filed Oct. 5, 2007, the entirety of which is herein incorporated by reference.

FIELD OF THE INVENTION

Embodiments of the invention relate to lighting assemblies that selectively illuminate products in display cases such as vending machines.

BACKGROUND OF THE INVENTION

Display cases, including vending machines, historically have used fluorescent sources to light the interior of the case. However, the fluorescent bulbs used in such applications have limited life and must be replaced often. The electrodes in fluorescent bulbs are easily burnt out or broken, requiring that the entire bulb be replaced. Moreover, the glass bulbs themselves are susceptible to breakage.

The fluorescent bulbs have been positioned in various locations within the cases, including at the top or along the sides of the case. A lamp provided at the top of the unit illuminates the products positioned near the top of the case, but fails to adequately illuminate those products positioned lower within the case. The use of multiple lamps positioned vertically down the sides of the case illuminate the products located towards the sides of the case but inadequately illuminate those positioned more central within the case. In the case of vending machines, insufficient illumination of products within the machine and the associated codes for their selection can lead to errors in selection of the products. Moreover, the use of multiple lamps increases the energy and thus cost needed to adequately illuminate the case. There is a need to illuminate products within a display case such as a vending machine more efficiently and effectively.

SUMMARY OF EMBODIMENTS OF THE INVENTION

Embodiments of the invention provide display cases having lighting assemblies and methods of illuminating display cases with such lighting assemblies. Embodiments of the lighting assemblies may be used in display cases of any type and particularly in those where the purchaser selects via an external mechanism (e.g., buttons) a product from a variety of products stored inside the display, such as a vending machine. Lighting assemblies are installed within a vending machine, such as on or within the vending machine shelves or product dividers, and their light emission controlled depending on the product being selected from the vending machine. In on embodiment, all light sources within the vending machine except those illuminating the selected product are dimmed. In this way, the product being selected by the purchaser can be emphasized. In other embodiments, color or multi-color LEDs are used to emit light of a color that best compliments the colors of the products housed within the vending machine.

DETAILED DESCRIPTION OF EMBODIMENTS OF THE INVENTION

Embodiments of this invention provide lighting assemblies for installation in display cases. While the lighting assemblies are discussed for use with vending machines, they by no means are so limited. Rather, embodiments of the lighting assemblies may be used in display cases of any type and particularly in those where the purchaser selects via an external mechanism (e.g., buttons) a product from a variety of products stored inside the display.

Figure 1:
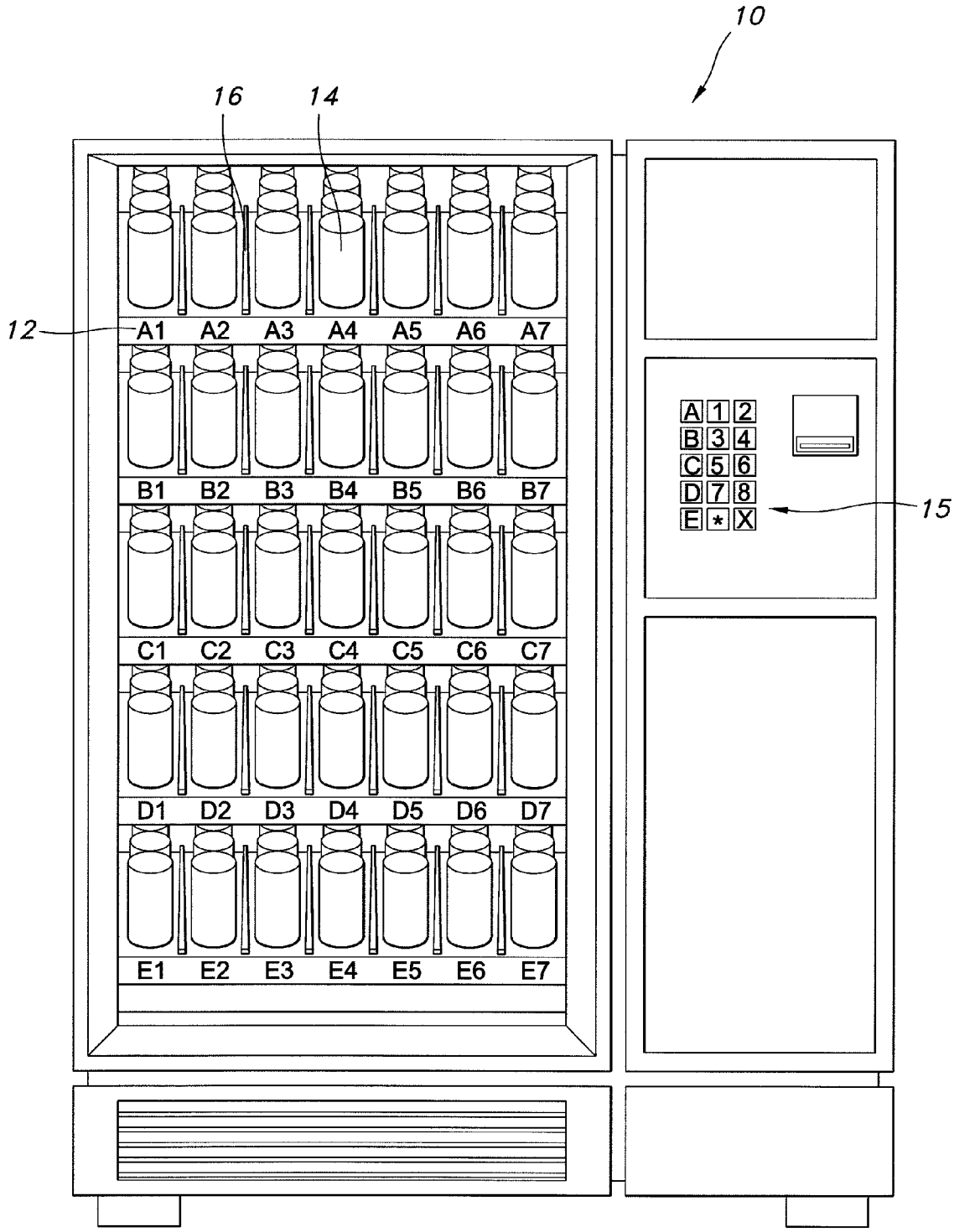
FIG. 1 is a front elevation view of a vending machine.

FIG. 1 illustrates an embodiment of a vending machine 10. The vending machine 10 includes shelves 12 that can support a variety of products 14 (drinks, snacks, etc.). Shelf dividers 16 may be, but do not have to be, provided to help separate the various products 14 supported on a shelf 12. The columns and rows of products 14 in the vending machine 10 define a matrix of product cells.

A unique product code (A1-A7; B1-B7; C1-C7; D1-D7; E1-E7) is assigned to each product cell and located adjacent each product 14. While the codes may be numbers, letters, symbols, shapes, etc., the product codes are typically alphanumeric. The product cells on each shelf 12 are typically assigned the same letter but have a unique number (e.g., A1, A2, A3, etc.). In use, a purchaser inserts money into the machine 10 and enters via selection buttons 15 the product code associated with the product 14 he wishes to purchase. It thus is extremely important that the purchaser be able to see both the products 14 and their associated codes to purchase the precise product 14 desired.

Figure 2:
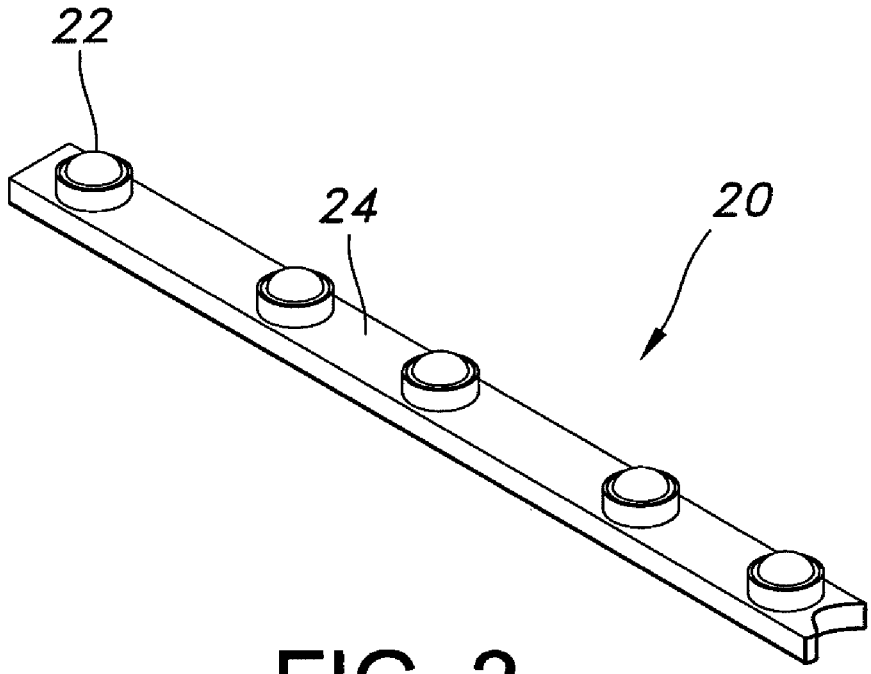
FIG. 2 is an isometric view of a lighting assembly according to one embodiment of the present invention.
Figure 3:
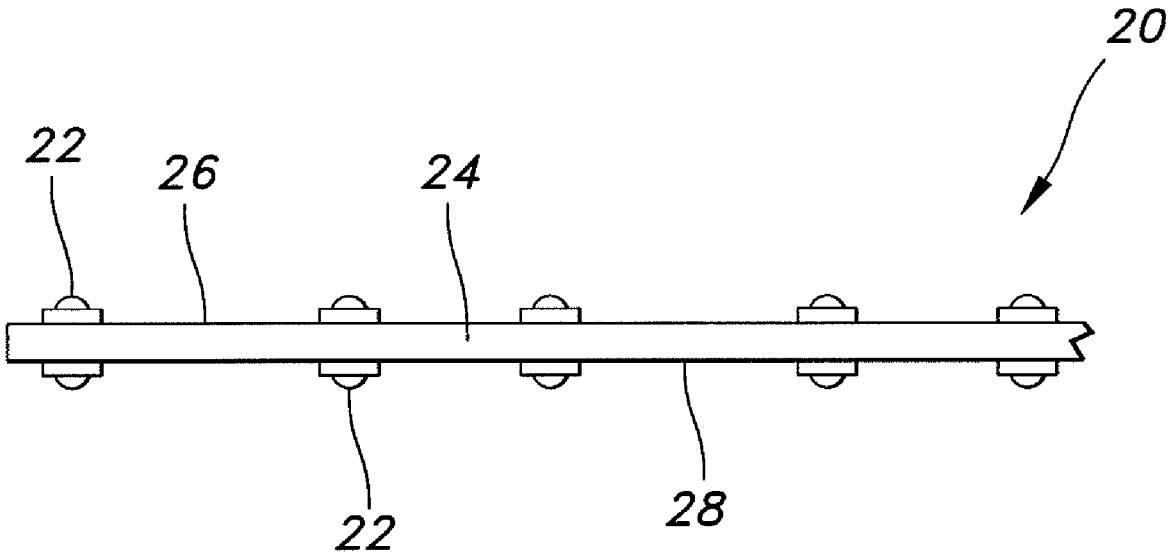
FIG. 3 is a side elevation view of the lighting assembly of FIG. 2.

FIGS. 2 and 3 illustrate one embodiment of a lighting assembly 20. The lighting assembly 20 includes a plurality of light sources, such as solid state light sources such as light emitting diodes 22 ("LEDs"), mounted on a printed circuit board 24 ("PCB"). The LEDs 22 may be mounted on one or both sides of the PCB 24. FIGS. 2 and 3 illustrate LEDs 22 mounted on both the top 26 and bottom 28 of the PCB 24. For ease of discussion, the light sources are referred to generally as LEDs. However, other light sources may be used. Moreover, the LEDs 22 referenced herein can be single-die or multi-die light emitting diodes, DC or AC, or can be an organic light emitting diodes (O-LEDs). The lighting assemblies 20 need not use only white LEDs 22. Rather color or multicolor LEDs 22 may be provided. Nor must all of the LEDs 22 within a lighting assembly 20 be the same color. The PCB 24 can be, among other things, metal core board, FR4 board, CHM1 board, etc. Any number of LEDs 22 may be mounted on the PCB 24 at any number of locations along the PCB 24. The lighting assemblies 20 may include, but do not have to include, various optical features to enhance the distribution of light emitted from the LEDs 22, including, but not limited to, lenses, reflectors, refractors, wave guides, etc.

Figure 4:
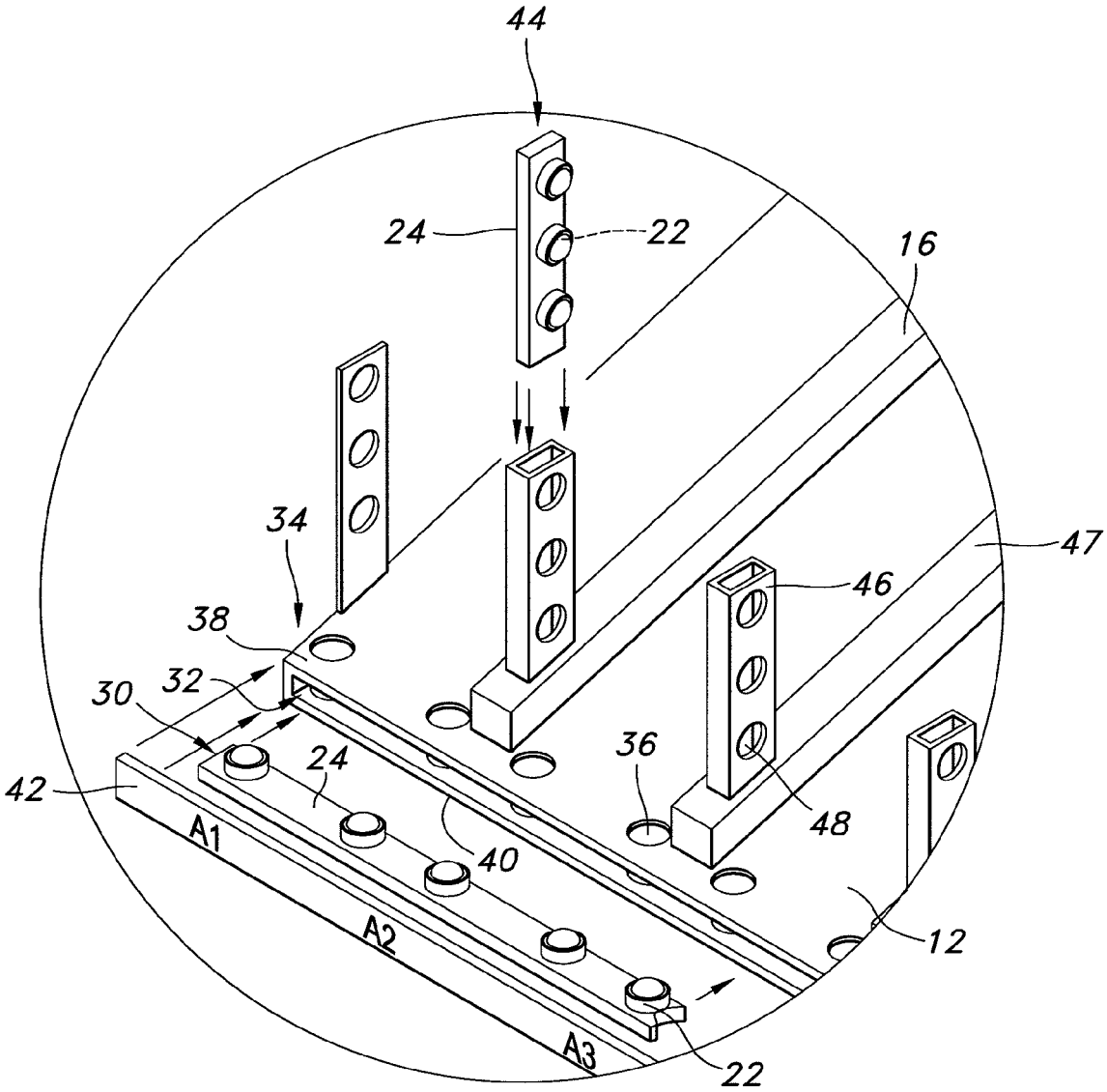
FIG. 4 is an enlarged isometric view of embodiments of lighting assemblies being installed in a vending machine.
Figure 5:
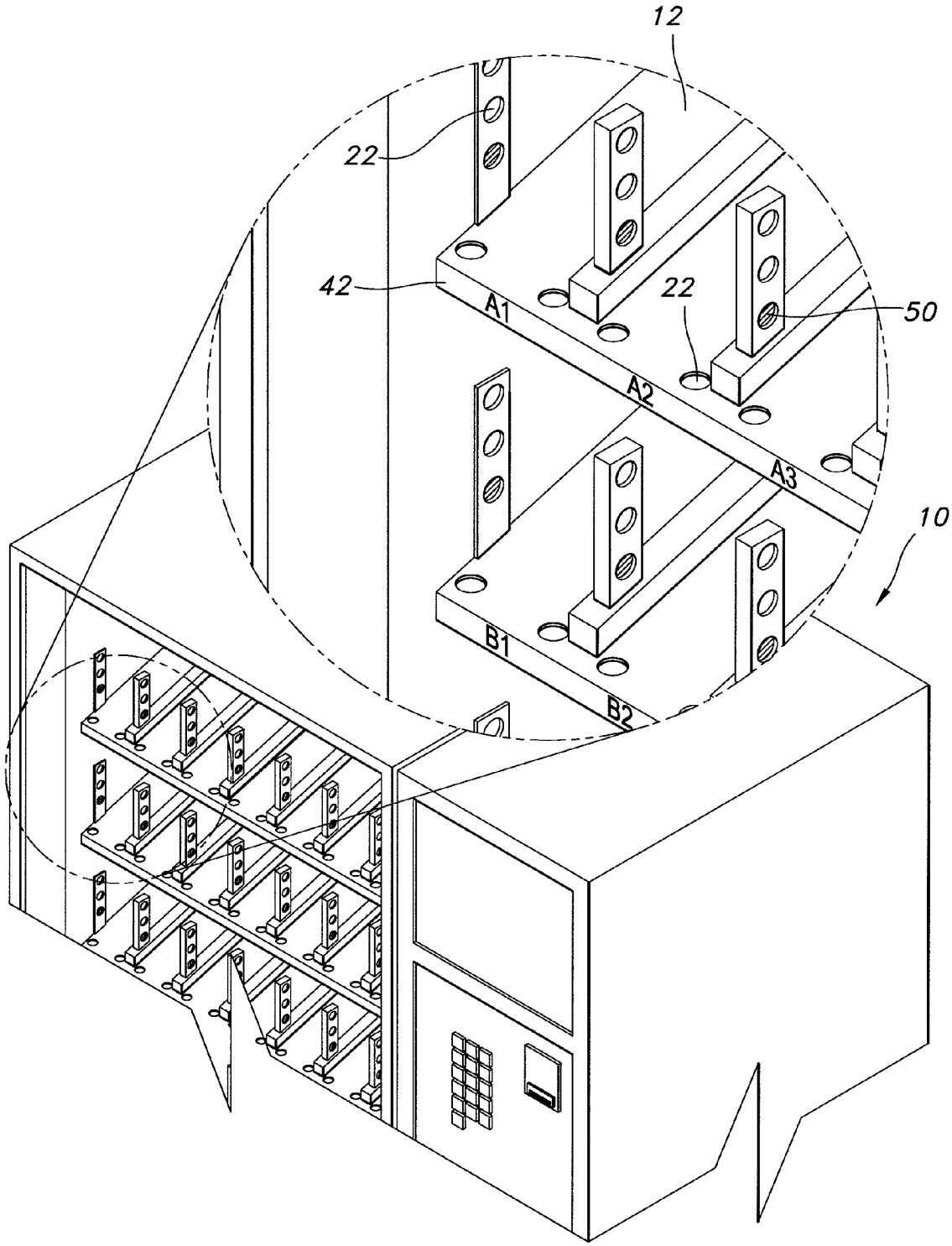
FIG. 5 is a partial isometric view of a vending machine with a circular enlargement showing embodiments of lighting assemblies installed in the vending machine.

FIG. 4 illustrates embodiments of the lighting assemblies 20 being installed in a vending machine 10, and FIG. 5 illustrates the vending machine 10 with the lighting assemblies 20 installed therein. The products have been removed for ease of illustration. The lighting assemblies 20 can be positioned in a variety of locations and retained in the vending machine 10 in a variety of ways. In one embodiment, lighting assemblies 20 are positioned and retained on the end of shelves 12 so that the LEDs 22 illuminate the products 14 supported by the shelves 12. In the embodiment of FIG. 4, a first set 30 of lighting assemblies 20 are slid into recesses 32 formed in the end edge 34 of the shelves 12. LED apertures 36 are provided along the edge 34 of the shelves 12 to align with the LEDs 22 on the PCBs 24. If the lighting assembly 20 includes LEDs 22 on both the top 26 and bottom 26 of the PCB 24 (as shown in FIGS. 2 and 3), then LED apertures 36 may be provided in both the top 38 and bottom 40 of the shelf 12. When the PCB 24 is inserted into the recess 32, the LEDs 22 on the PCB 24 align with the LED apertures 36 on the shelf 12. In this way, the LEDs emitted light projects through the LED apertures 36 to illuminate products positioned above and/or below the lighting assembly 20. A cover 42, upon which the product codes are placed, can be used to seal the end of the shelf 12 and retain the lighting assembly 20 in the shelf 12. The cover 42 can be formed from any metallic or polymeric material and can be retained on the shelf 12 via any mechanical (e.g., snap-fit, fastener, etc.) or chemical (e.g., adhesive) method.

One of skill in the art will understand that the first set 30 of lighting assemblies 20 may be mounted on or in the shelf 12 in a variety of ways and orientations, and this invention is not limited to the configuration illustrated in FIG. 4. By way only of example, in one alternative embodiment, the shelf 12 is a single sheet of plastic or metal whose end is formed so as to fold under itself to form a ledge. The PCB can be slid into and supported by the ledge. In another alternative embodiment, at least a portion of a shelf 12 could be formed of a transparent material (such as plastic) and the LEDs 22 embedded at various locations within the shelf 12 to illuminate product cells from the top, bottom, and/or side. Moreover, while the first set 30 of lighting assemblies 20 are shown extending across the width of a shelf 12, they need not. Rather, the LEDs 22 could extend along the depth of the shelf 14 to illuminate the products from the side only.

In the embodiment of FIGS. 4 and 5, a second set 44 of lighting assemblies 20 is provided adjacent the products. For example, the dividers 16 may be formed so as to have upstanding arms 46 that extend from a base 47, each for receiving and retaining a lighting assembly 20 with any number of LEDs 22 mounted thereon. One or both sides of the arms 46 include LED apertures 48 that align with the LEDs 22 provided on the lighting assemblies 20. Alternatively, the lighting assemblies could be positioned directly in the base 47 of the dividers 16. When activated, the light from the LEDs 22 is emitted through the apertures 48 to illuminate adjacent products.

One of skill in the art will understand that the second set 44 of lighting assemblies 20 may be mounted on or in the product dividers 16 in a variety of ways and this invention is not limited to the configuration illustrated in FIGS. 4 and 5. Retention of the lighting assemblies 20 within the machine 10 is not limited to the methods disclosed herein; rather, they may be retained via any mechanical or chemical retention method, including, but not limited to, the use of mechanical fasteners or adhesive. Moreover, the arrangement of the LEDs 22 on the PCBs 24 and the pattern of LED apertures 36, 48 within the vending machine 10 may be varied depending on, among other things, product placement, shelf configuration, etc.

While two sets 30, 44 of lighting assemblies 20 are described for use in vending machine 10, they need not be. Rather, any number of lighting assemblies 20 may be used.

A controller (not shown but which can be positioned anywhere within the vending machine 10) can be used to control illumination of the LED 22. In one embodiment, the controller is positioned adjacent buttons 15. The LED chips can be controlled with DMX, DALI, CAN, $I^2C$, wireless, or any other communication protocol that enables remote and easy control of the single or multicolor LEDs. In this way, the product being selected by the purchaser can be showcased.

Figure 6:
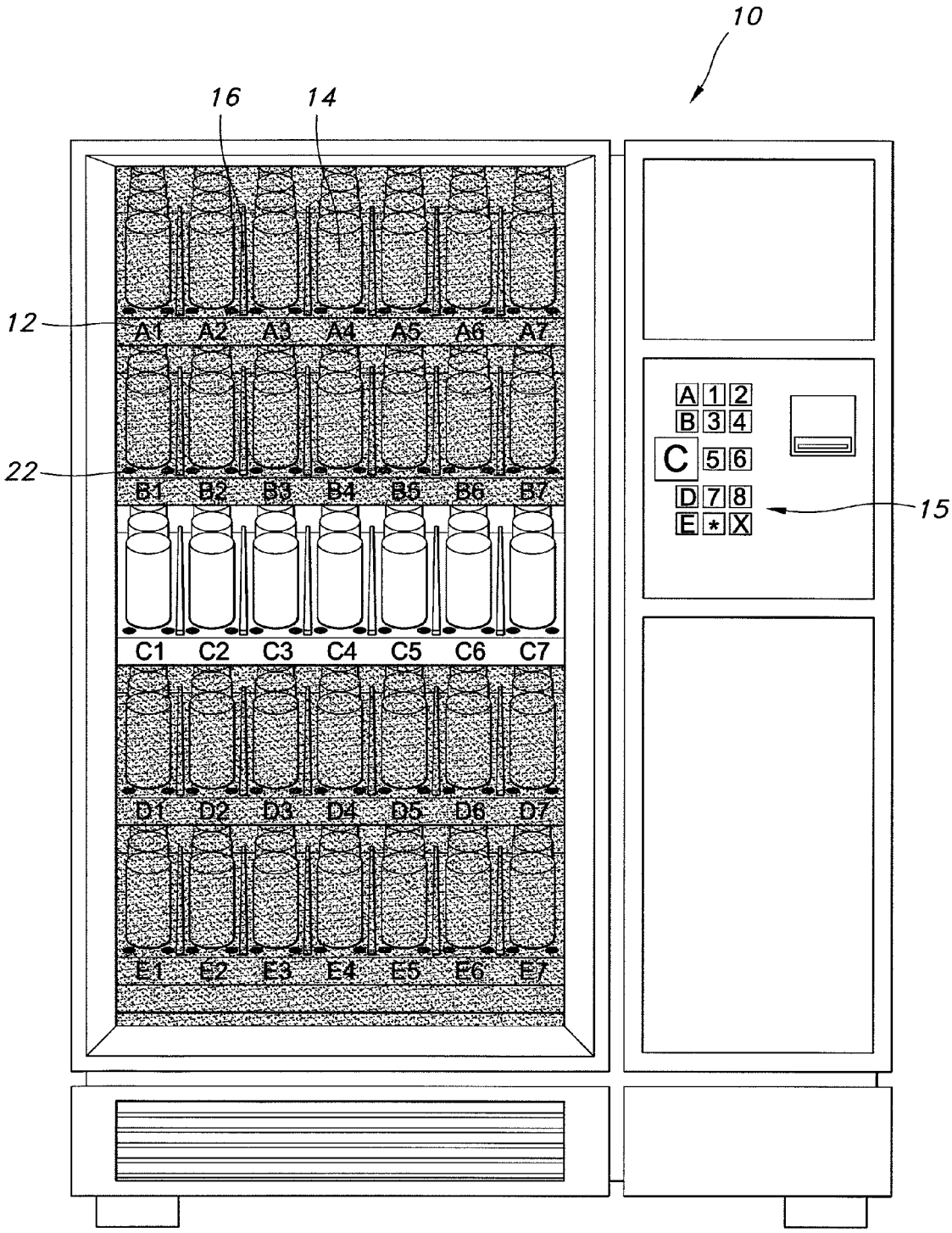
FIG. 6 is an front elevation view of a vending machine with a shelf illuminated.
Figure 7:
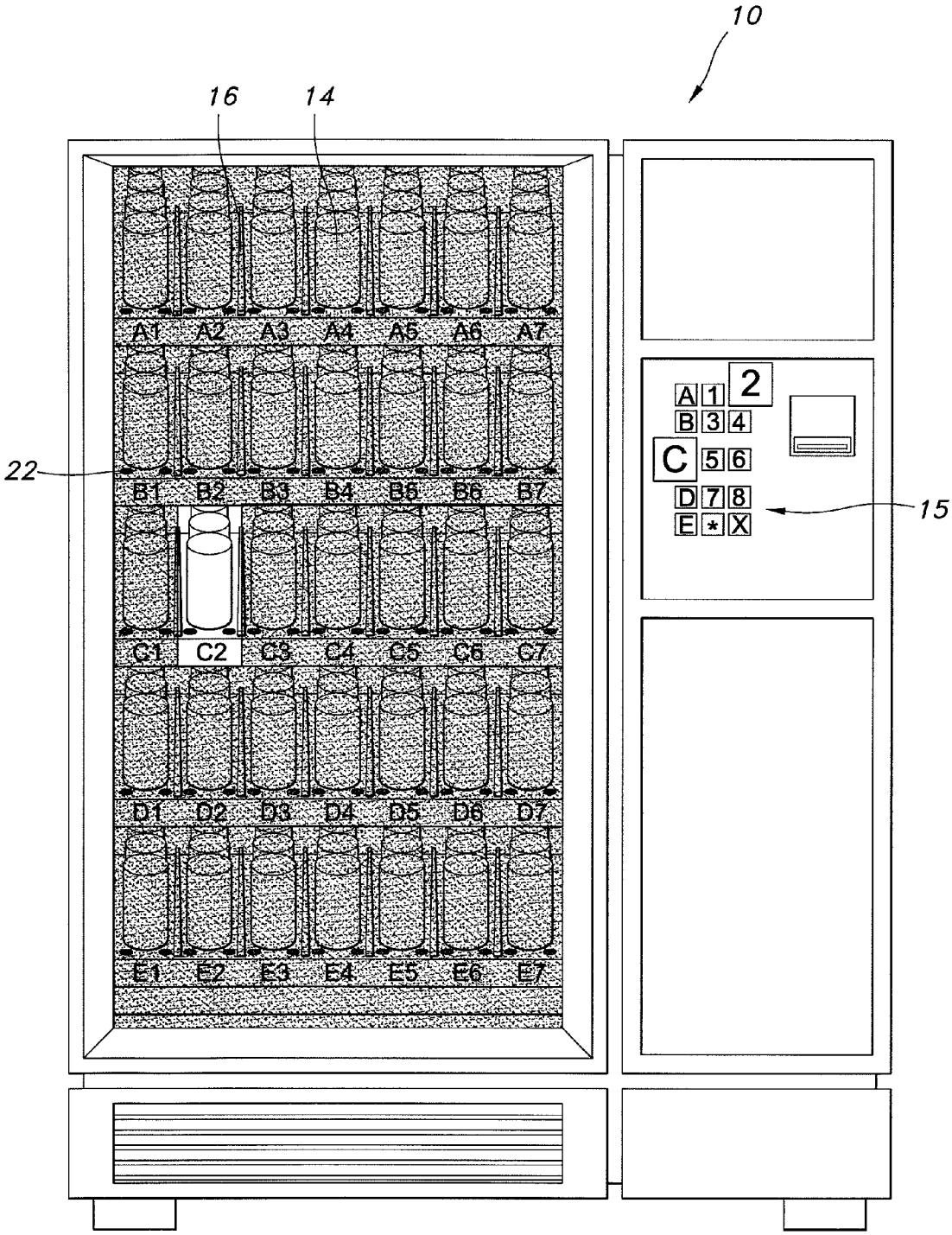
FIG. 7 is an front elevation view of a vending machine with a product cell illuminated.

For example, assume a purchaser desires to select the product 14 located in the product cell having the code "C2." When he pushes the "C" button, the controller can cause the LEDs 22 that are not in row "C" to change appearance, such as dim to a certain level, go out, change colors, etc., as illustrated in FIG. 6. Alternatively or in addition, the controller can cause the LEDs 22 in row "C" to change appearance, such as brighten, change color, flash, etc. In this way, all of the products 14 in row "C" become better lit and stand out more than the other products 14 in the machine 10. Upon entry of "2" (to complete the code C2), all of the LEDs 22 in row "C" that do not correspond to the C2 product cell (i.e., product cells C1 and C3-C7) could similarly dim, change color, etc. so that the product 14 being selected is emphasized, as shown in FIG. 7.

This discussion assumes that the codes are assigned so that the product cells in a row are assigned the same code letter. However, illumination of the LEDs 22 within the machine 10 may be varied depending on how the codes are assigned in the vending machine 10. For example, if product cells within a column (as opposed to a row) all have the same code letter, then, upon entry of that letter, illumination of the LEDs 22 could be altered to emphasize all of the products within a column (as opposed to a row).

To conserve energy and associated costs, the vending machine 10 need not be illuminated at all times (e.g., the LEDs 22 could be programmed to turn off at night) or be illuminated the same at all times. Moreover, not all of the LEDs 22 need be illuminated at the same time, but rather one can selectively illuminate some or all of the LEDs 22 as desired. For example, a sensor, including but not limited to an occupancy sensor, laser sensor and other types of mechanical, optical, and sound sensors, may be used to detect the presence of a product within a product cell. While the sensor may be positioned in various locations within the vending machine 10, in one embodiment such a sensor (represented as 50) may be mounted on the PCBs 24 in the second set 44 of lighting assemblies 20, as shown in FIG. 5. If the sensor fails to detect a product, then the controller can turn off or dim the LEDs 22 positioned to illuminate the empty product cell, thus rendering it less likely that a purchaser mistakenly enters the product code for that empty product cell.

By way of another example, the LEDs 22 in the first set 30 of lighting assemblies 20 may be lit until a selection is being made, and the LEDs 22 in the second set 44 of lighting assemblies 22 may be dim or off until a selection is being made. When the purchaser pushes the "C" button, the LEDs 22 in the first set 30 that are not in the row of "C" cells can change appearance (i.e., dim to a certain level, change colors, etc.) as described above. Only upon entry of the numeric component of the code (the "2" to complete the code C2) do the LEDs 22 in the second set 44 adjacent the product located in the C2 product cell illuminate. In this way, the LEDs 22 in the second set 44 have the potential to illuminate only upon use of the vending machine 10.

With colored discrete or multicolor die LEDs 22, it is possible to select a variety of colors with which to illuminate the inside of the vending machine 10 or to program specific colors for each section or product cell of the vending machine 10. Such LEDs 22 can be used to impart a particular color to products within the vending machine 10. By way only of example, the LEDs 22 could be programmed to emit light of a color that compliments the coloring of the product and/or its associated packaging positioned directly adjacent the LEDs 22, resulting in improved product color rendering. Color mixing could be used to attain the desired light emission color.

A product cell is not always replenished with the same product 14. Thus, it may be beneficial to include a sensor for detecting color, including but not limited to a chromaticity sensor, associated with each product cell. While the sensor may be positioned in various locations within the vending machine 10, in one embodiment such a sensor (represented as 50) may be mounted on the PCBs 24 in the second set 44 of lighting assemblies 20, as shown in FIG. 5. The sensor could detect the colors of a product and/or its packaging within a product cell and relay that information to the controller. The controller, in turn, could assign the desired color to emit from the LEDs 22 adjacent that product cell based on the data transmitted from the sensor. In this way, the system can quickly accommodate product changes to ensure that products currently positioned within the product cells are optimally illuminated. Any number of such sensors may be located anywhere in the vending machine so long as they are able to perform the above-described function.

The light output of the LEDs 22 need not be consistent. Rather, the LEDs 22 may be programmed to change in appearance. For example, the LEDs 22 may flash, increase and decrease in brightness and/or color, color sweep, switch on and off to create a bubbling effect simulating soda, pulsate, and/or create a moving effect, such as by racing across the unit or creating the appearance of a wave. It is contemplated that such lighting effects could be triggered upon detection (such as by a motion sensor provided in, on, or near the vending machine 10) of a person approaching the machine 10. Alternatively, such effects could be triggered upon entry of a product code, as described above.

Ultraviolet LEDs may be used to reduce energy costs during non-peak times. During these times, the ultraviolet LEDs would illuminate fluorescent materials on the products or refrigerated unit labels. Such ultraviolet LEDs may be used to create a glowing affect that would make graphics strikingly visible in the dark.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A vending machine comprising:

a. a plurality of product cells, each for containing a product;

b. a plurality of light sources positioned in the vending machine to illuminate at least some of the product cells, wherein at least some of the light sources comprise LEDs;

c. selection means for selecting a product;

d. a controller for controlling illumination of at least some of the light sources, wherein the controller alters illumination of at least some of the light sources during or upon selection of a product;

e. a plurality of shelves; and f. at least one product divider positioned on a shelf, wherein at least one of the LEDs is positioned in the at least one product divider.

2. The vending machine of claim 1, wherein a portion of a shelf is transparent and wherein at least some of the LEDs are embedded in the shelf.

3. The vending machine of claim 1, wherein each shelf comprises an edge and wherein at least some of the LEDs are positioned along the edges of at least some of the shelves.

4. The vending machine of claim 3, wherein the at least some of the shelves comprise LED apertures that align with the LEDs positioned along the edges of the shelves so that the LEDs emit light through the LED apertures.

5. The vending machine of claim 1, further comprising a printed circuit board on which at least one LED is mounted, wherein at least one shelf comprises a recess into which the printed circuit board is positioned and at least one LED aperture that aligns with the at least one LED when the printed circuit board is positioned in the recess.

6. The vending machine of claim 1, wherein the at least one product divider comprises an upstanding arm and wherein the at least one LED is positioned in the upstanding arm.

7. The vending machine of claim 6, further comprising a printed circuit board on which the at least one LED is mounted, wherein the upstanding arm comprises at least one LED aperture that aligns with the at least one LED when the printed circuit board is positioned in the upstanding arm.

8. A vending machine comprising:

a. a plurality of product cells, each for containing a product;

b. a plurality of light sources positioned in the vending machine to illuminate at least some of the product cells;

c. selection means for selecting a product;

d. a controller for controlling illumination of at least some of the light sources, wherein the controller alters illumination of at least some of the light sources during or upon selection of a product; and e. a unique product code associated with each product cell, wherein each product code comprises at least a first component and a second component.

9. The vending machine of claim 8, wherein the selection means comprises means for inputting the product code into the vending machine, wherein the controller alters illumination of at least some of the LEDs upon inputting the first component of the product code.

10. The vending machine of claim 9, wherein, after inputting the first component of the product code, the controller alters illumination of at least some of the LEDs upon inputting the second component of the product code.

11. A vending machine comprising:

a. a plurality of product cells, each for containing a product;

b. a plurality of light sources positioned in the vending machine to illuminate at least some of the product cells;

c. selection means for selecting a product;

d. a controller for controlling illumination of at least some of the light sources, wherein the controller alters illumination of at least some of the light sources during or upon selection of a product; and e. products having packaging and positioned in at least some of the product cells, wherein at least one LED is positioned to illuminate a product cell and comprises a color or multi-color LED that emits light of a color at least partially dependent on a color of the product or packaging located in the product cell.

12. The vending machine of claim 11, further comprising a sensor to detect at least one color of the product or the packaging and relay the at least one color to the controller, wherein the controller can alter the color of the light emitted from the at least one LED based on the relayed color.

13. A method of illuminating a vending machine comprising:

a. providing a vending machine comprising:

i. a plurality of product cells, each for containing a product, wherein the product cells define rows within the vending machine and wherein a unique product code comprising at least a first component and a second component is associated with each product cell;

ii. a plurality of LEDs positioned in the vending machine to illuminate at least some of the product cells;

iii. selection means for selecting a product, wherein the selection means comprises means for inputting a product code into the vending machine; and iv. a controller for controlling illumination of at least some of the LEDs; and b. altering illumination of at least some of the LEDs during or upon selection of a product.

14. The method of claim 13, wherein altering illumination comprises altering illumination of at least some of the LEDs upon inputting of the first component of a product code.

15. The method of claim 14, wherein altering illumination further comprises altering illumination of other of the LEDs upon inputting of the second component of the product code.

16. A method of illuminating a vending machine comprising:

a. providing a vending machine comprising:

i. a plurality of product cells, each for containing a product, wherein the product cells define rows within the vending machine;

ii. a plurality of LEDs positioned in the vending machine to illuminate at least some of the product cells;

iii. selection means for selecting a product; and iv. a controller for controlling illumination of at least some of the LEDs; and b. altering illumination of at least some of the LEDs during or upon selection of a product, wherein altering illumination comprises dimming all LEDs in the vending machine except the LEDs that illuminate a single row in the vending machine.

17. A method of illuminating a vending machine comprising:

a. providing a vending machine comprising:

i. a plurality of product cells, each for containing a product, wherein the product cells define rows within the vending machine;

ii. a plurality of LEDs positioned in the vending machine to illuminate at least some of the product cells;

iii. selection means for selecting a product; and iv. a controller for controlling illumination of at least some of the LEDs; and b. altering illumination of at least some of the LEDs during or upon selection of a product, wherein altering illumination comprises dimming all LEDs in the vending machine except the LEDs that illuminate a single product cell.

18. A vending machine comprising:

a. a plurality of product cells, each for containing a product;

b. a plurality of shelves, wherein at least some of the shelves comprise at least one LED aperture;

c. a first set of lighting assemblies positioned on or within at least some of the shelves to illuminate at least some of the product cells, wherein each lighting assembly of the first set comprises at least one LED and wherein the at least one LED emits light through the at least one LED aperture of a shelf when the lighting assembly is positioned on or within the shelf;

d. a plurality of product dividers, wherein at least some of the product dividers comprise at least one LED aperture;

e. a second set of lighting assemblies positioned on or within at least some of the product dividers to illuminate at least some of the product cells, wherein each lighting assembly of the second set comprises at least one LED and wherein the at least one LED emits light through the at least one LED aperture of a product divider when the lighting assembly is positioned on or within the product divider;

f. selection means for selecting a product; and g. a controller for controlling illumination of at least some of the LEDs, wherein the controller alters illumination of at least some of the LEDs during or upon selection of a product.

19. A vending machine comprising:

a. a plurality of product cells, each for containing a product;

b. a plurality of products positioned in at least some of the plurality of product cells, wherein each product comprises product packaging, wherein each product and its product packaging collectively comprise at least one color, and wherein a product is positioned in a first product cell;

c. a plurality of light sources positioned in the vending machine to illuminate at least some of the product cells, wherein the light source positioned to illuminate the first product cell comprises a color or multicolor LED, wherein the LED emits light of at least one color;

d. at least one sensor for detecting the at least one color of the product positioned in the first product cell; and e. a controller for controlling the at least one color of light emitted by the LED, wherein the at least one color of light emitted by the LED is at least partially dependent on the at least one color detected by the at least one sensor.

20. A method of illuminating a vending machine comprising:

a. providing a vending machine comprising:

i. a plurality of product cells, each for containing a product;

ii. a plurality of products positioned in at least some of the plurality of product cells, wherein each product comprises product packaging, wherein each product and its product packaging collectively comprise at least one color, and wherein a product is positioned in a first product cell;

iii. a plurality of light sources positioned in the vending machine to illuminate at least some of the product cells, wherein the light source positioned to illuminate the first product cell comprises a color or multicolor LED, wherein the LED emits light of at least one color;

iv. at least one sensor; and v. a controller for controlling the at least one color of light emitted by the LED;

b. detecting the at least one color of the product positioned in the first product cell with the sensor;

c. relaying the detected at least one color to the controller; and d. altering the at least one color of light emitted by the LED based on the relayed at least one color.

21. A method of illuminating a vending machine comprising:

a. providing a vending machine comprising:

i. a plurality of product cells, each for containing a product, wherein at least one product cell is empty of a product;

ii. a plurality of products positioned in at least some of the plurality of product cells;

iii. a plurality of light sources positioned in the vending machine to illuminate at least some of the product cells, including the empty product cell;

iv. at least one sensor; and v. a controller for controlling illumination of the light sources;

b. detecting lack of a product in the empty product cell with the sensor; and c. upon such detection, altering illumination of at least one light source positioned to illuminate the empty product cell.

* * * * *